US005263205A

United States Patent [19]

Leunissen

[11] Patent Number: 5,263,205

[45] Date of Patent: Nov. 23, 1993

[54] SPRAY DEVICE FOR TOILET

[76] Inventor: Henry P. Leunissen, 1039 E. Fairbrook Cir., Mesa, Ariz. 85203

[21] Appl. No.: 598,858

[22] Filed: Oct. 15, 1990

[51] Int. Cl.[5] ..... E03D 9/08

[52] U.S. Cl. ..... 4/420.4; 4/447

[58] Field of Search ..... 4/DIG. 7, 420.1, 420.4, 4/443, 447, 444, 448, 420.5

[56] References Cited

U.S. PATENT DOCUMENTS

| | | | |
|---|---|---|---|
| 1,346,252 | 7/1920 | Rathbone | 4/447 |
| 1,659,807 | 2/1928 | Campus | 4/420.5 |
| 1,690,478 | 11/1928 | Crane | 4/420.5 |
| 1,787,481 | 1/1931 | Kellogg | 4/420.4 |
| 4,181,985 | 1/1980 | Rius | 4/420.4 |
| 4,422,190 | 12/1983 | Huang | 4/443 |
| 4,558,473 | 12/1985 | Morikawa | 4/420.5 X |
| 4,642,820 | 2/1987 | Boring, Jr. | 4/420.4 |
| 4,807,311 | 2/1989 | Ingels | 4/443 |
| 4,953,238 | 9/1990 | Shifferly | 4/447 |

FOREIGN PATENT DOCUMENTS

| | | | |
|---|---|---|---|
| 2142055 | 1/1985 | United Kingdom | 4/420.4 |

OTHER PUBLICATIONS

*Private Spring TM Bidet Installation and Operating Instructions*, J. Campbell and Associates, ©1989.

*Primary Examiner*—William A. Cuchlinski, Jr.
*Assistant Examiner*—G. Bradley Bennett
*Attorney, Agent, or Firm*—Don J. Flickinger; Jordan M. Meschkow

[57] ABSTRACT

An adaptor having an outlet is used to couple a waterline to a tank of a toilet. A flow regulator valve is coupled to the adaptor to regulate water flow from the waterline to a nozzle assembly attached to a seat of said toilet. A flow release valve couples the nozzle assembly to the flow regulator valve.

16 Claims, 3 Drawing Sheets

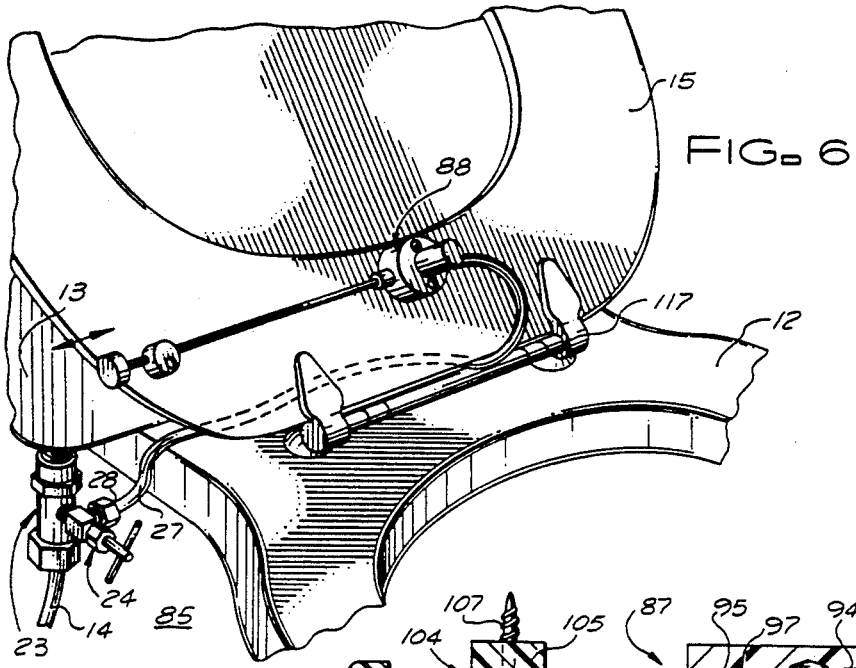
FIG. 6
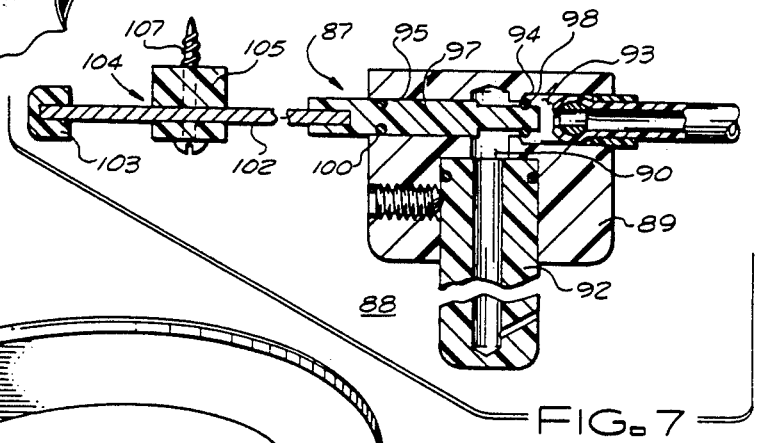
FIG. 7
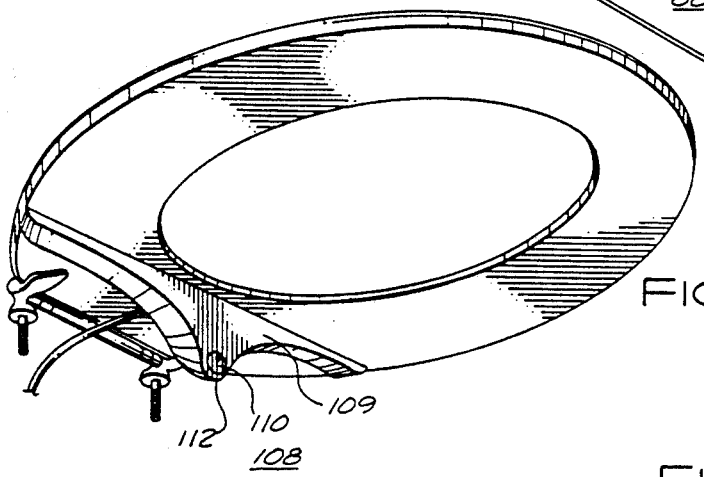
FIG. 8
FIG. 9
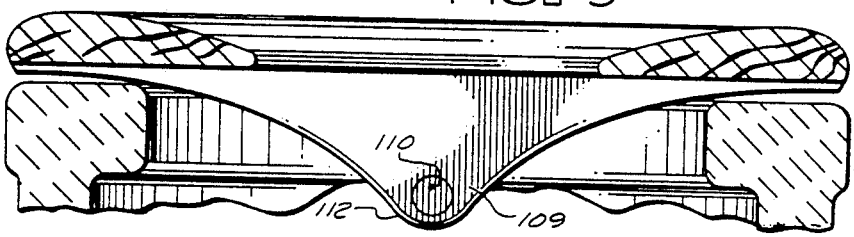

SPRAY DEVICE FOR TOILET

BACKGROUND 0 THE INVENTION

1. Field of the Invention

This invention relates to a hygienic device for a toilet. More particularly, this invention relates to a spray device which can be easily installed on a conventional toilet.

2. Prior Art

Spray devices used in conjunction with toilets for purpose of hygiene are well known. These spray devices, called bidets, may be units separate from the toilets. This, however, is inconvenient, expensive and occupies a great deal of space. A more practical approach is an integrated bidet. Toilets with a built in spray device are also very expensive. Typically these devices require specialized toilets and include a heating system for heating the water, a water reservoir and possibly a device to mix air with the water. All these elements cause a great deal of complexity, and prohibit do-it-yourself installation. Usually, to obtain one of these integrated spray devices, one must purchase a toilet with the device installed during production. Thus the old toilet must be removed and a new expensive one purchased.

It would be highly advantageous, therefore, to remedy the foregoing and other deficiencies inherent in the prior art.

Accordingly, it is an object of the present invention to provide an inexpensive hygienic spray device for a toilet.

Another object of the present invention is to provide a spray device which may be easily installed.

And another object of the present invention is to provide a spray device which can be installed on a conventional toilet.

Still another object of this invention is to provide a spray device which is easy to operate.

Yet another object of this invention is to provide a spray device which is easy to clean.

Yet still another object is to provide a spray device with easily controlled water flow.

SUMMARY OF THE INVENTION

Briefly, to achieve the desired objects of the present invention in accordance with a preferred embodiment thereof, provided is an adaptor which is removably coupled to the waterline of a toilet. A flow regulator valve is coupled to the adaptor and allows adjustment of the flow of water to a nozzle. A nozzle assembly is attached to the back of a toilet seat and is supplied by a flexible tube coupling it to a flow release valve. The flow release valve is coupled to the flow regulator valve to release the flow of water to the nozzle assembly.

In accordance with a further embodiment, the flow release valve is attached to the base of the nozzle assemby with an extension rod extending therefrom for ease in operation. The flow release valve is coupled to the flow regulator valve by the flexible tube.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 6 is a perspective view of an alternate embodiment of the present invention installed on a conventional toilet;

FIG. 7 is a sectional side view of the flow release valve and nozzle assembly of the alternate embodiment illustrated in FIG. 6;

FIG. 8 is a perspective view of a modified nozzle assembly attached to a conventional toilet seat to be used with the embodiment illustrated in FIG. 2;

FIG. 9 is a cross-sectional front view of a toilet illustrating the modified nozzle assembly shown in FIG. 8;

DETAILED DESCRIPTION OF THE PREFERRED EMBODIMENT

Figure 1:
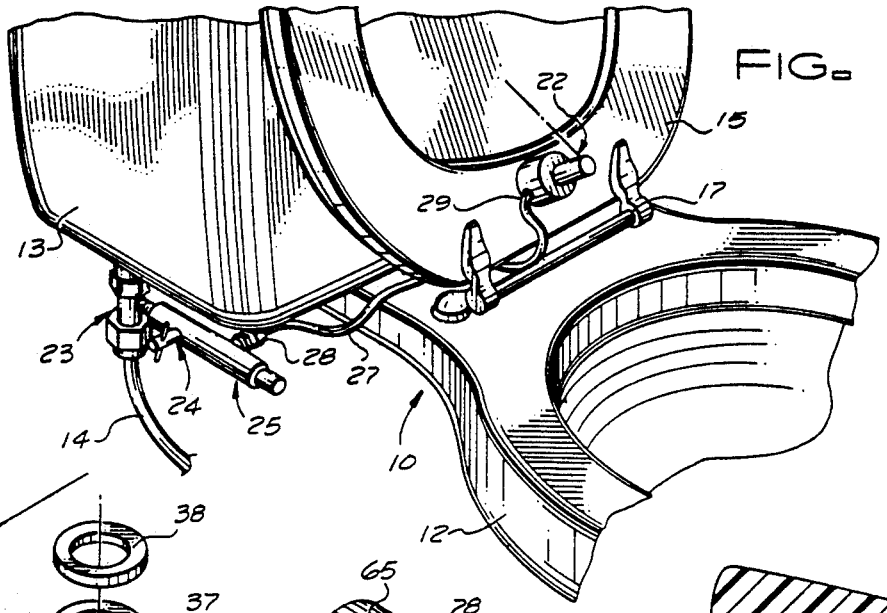
FIG. 1 is a perspective view illustrating the present invention installed on a conventional toilet.

Turning now to the drawings in which like reference characters indicate corresponding elements throughout the several views, attention is first directed to FIG. 1 which illustrates a conventional toilet generally designated 10 having a bowl 12, a tank 13, a waterline 14 and a seat 15 attached to bowl 12 by a hinge 17. A first embodiment, generally designated 20, of the present invention is shown installed on toilet 10. A nozzle assembly 22 is attached to the underside of seat 15 at the rear near tank 13. An adaptor 23 couples waterline 14 to flush tank 13 and allows a water flow direction other than to tank 13. A flow regulator valve 24 and a flow release valve 25, which in this embodiment are formed into a single unit, are coupled to adaptor 23 and control the flow of water to nozzle assembly 22. The water is transported to nozzle assembly 22 by a flexible tube 27 having a first end 28 coupled to flow release valve 25 and a second end 29 coupled to nozzle assembly 22.

Figure 2:
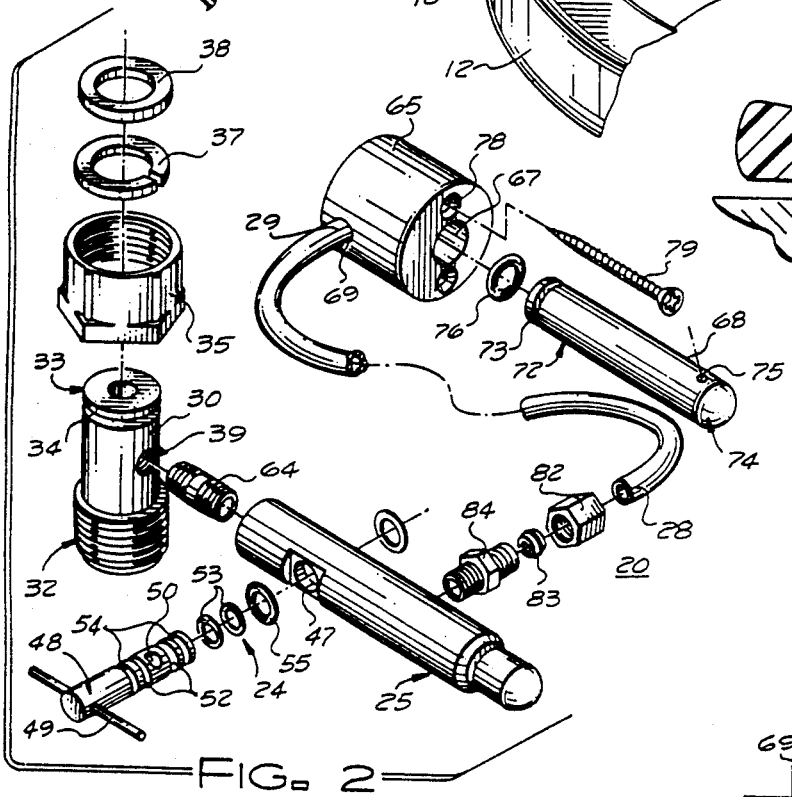
FIG. 2 is an exploded view illustrating a preferred embodiment of the present invention.
Figure 3:
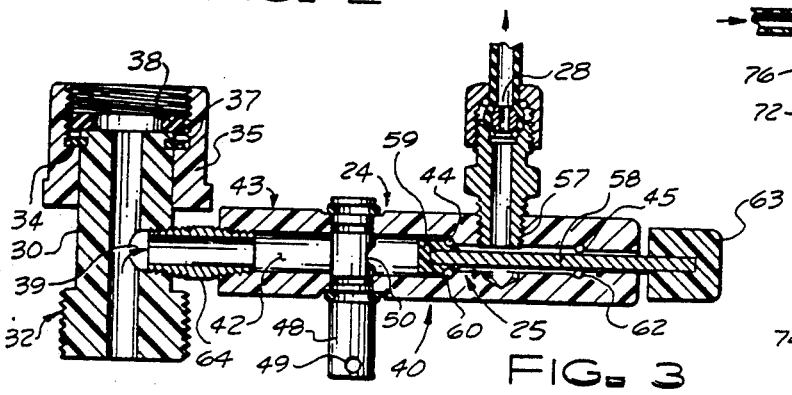
FIG. 3 is a sectional side view of the adaptor, flow regulator valve and flow release valve of the embodiment of FIG. 2.

Turning to FIG. 2, an exploded view of first embodiment 20 is illustrated. Adaptor 23 consists of a cylindrical tube 30 with a threaded end 32 and a grooved end 33 having a shallow groove 34 encircling it. A nut 35 slides over grooved end 33 and is prevented from slipping off by a lock washer 37 which fits into nut 35 and locks into groove 34. A ring gasket 38 fits into nut 35 after washer 37, to prevent leaks. As illustrated in FIG. 3, when adaptor 23 is attached to tank 13 by nut 35, lock washer 37 prevents cylindrical tube 30 from sliding out of nut 35 because lock washer 37 cannot pass through. Once adaptor 23 is attached to tank 13, waterline 14 can be attached to threaded end 32 of adaptor 23. A water outlet 39 is formed in adaptor 23 between threaded end 32 and end 33. Outlet 39 is a threaded opening in one side of, and perpendicular to the axis of cylindrical tube 30.

Referring to both FIG. 2 and FIG. 3, flow regulator valve 24 and flow release valve 25 can be seen to be one unit, consisting of a cylindrical pipe 40 having an opening 42 running axially therethrough. Cylindrical pipe 40 has a threaded end 43 which is used to couple flow regulator valve 24 to outlet 39 of adaptor 23 and will be discussed in more detail below. Opening 42 reduces in diameter as it extends distally from threaded end 43 along the axis of cylindrical pipe 40. The diameter is reduced in two steps, forming shoulders 44 and 45 inside cylindrical pipe 40, shoulder 45 being the furthest from threaded end 43. Flow regulator valve 24 is located where opening 42 is largest, before shoulder 44. A valve opening 47 extends through cylindrical pipe 40 perpendicularly to opening 42. A cylinder 48, having one end with a handle 49 and the other end having an opening 50 extending perpendicularly therethrough, fits through valve opening 47. When in place, opening 50 corresponds to opening 42 allowing a free flow of water therethrough. As cylinder 48 is rotated in valve opening 47, opening 50 gradually disaligns with opening 42 and slows the flow of water. A groove 52 encircles cylinder 48 on each side of opening 50 and contains a ring gasket 53 which seals valve opening 47. A second groove 54 encircles cylinder 48 outside of each groove 52 which hold washers 55. Washers 55 prevent cylinder 48 from being withdrawn from valve opening 47. FIG. 3 illustrates flow regulator valve 24 with cylinder 48 in place in cylindrical pipe 40.

Still referring to FIG. 3, opening 42, on the distal side of shoulder 44 from the threaded end 43, is connected to a threaded outlet 57 extending through one side of pipe 40 and perpendicular to the axis of cylindrical pipe 40. This portion forms a stem valve acting as flow release valve 25. A rod 58 extends from before shoulder 44 out the end of cylindrical pipe 40 opposite threaded end 43. A cap 59 is attached to the end of rod 58 which is of slightly smaller diameter than the first section of opening 42, but too large to pass through shoulder 44. A gasket 60 is attached to the distal end of cap 59. A second ring gasket 62 encircles rod 58 so that water cannot pass through shoulder 45. The distal end of rod 58 has a button 63 for ease in moving rod 58. When button 63 is pressed, rod 58 pushes against the water pressure, moving cap 59 away from shoulder 44. This allows water to pass through shoulder 44 and out outlet 57. When button 63 is not being pressed, water pressure from waterline 14 holds cap 59 against shoulder 44, preventing passage of water.

Flow regulator valve 24 and flow release valve 25 are coupled to adaptor 23 by a joint 64 which is a hollow cylinder threaded at both ends. Joint 64 is threaded into threaded end 43 of flow regulator valve 24. The opposite end of joint 64 is then threaded into outlet 39 of adaptor 23.

Figure 5:
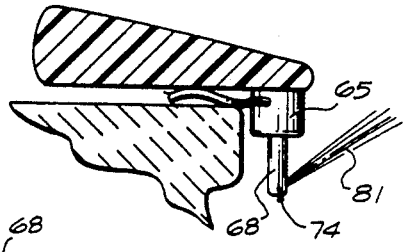
FIG. 5 is a perspective view of the nozzle assembly illustrated in FIG. 4 attached to a toilet in operating position.
Figure 4:
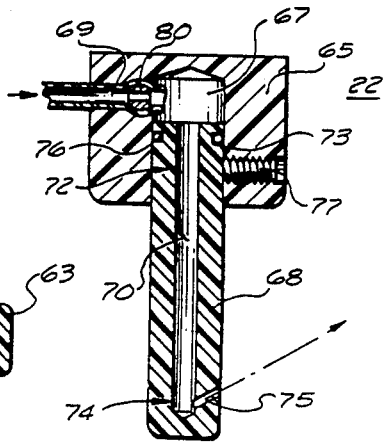
FIG. 4 is a sectional side view of a nozzle assembly in accordance with the preferred embodiment in FIG. 2.

Turning now to FIGS. 2 and 4, nozzle assembly 22 is illustrated. Nozzle assembly 22 has a cylindrical base 65 with an axial opening 67, having an open end and a closed end, into which a nozzle 68 is partially inserted. An inlet 69 joins with opening 67 and extends perpendicularly through one side of base 65. Inlet 69 joins the lower, closed end of opening 67 and is therefore not blocked when nozzle 68 is inserted. Nozzle 68 is cylindrical in shape with an axial opening 70 extending therethrough. An end 72 proximal to base 65 is open, with an encircling groove 73. Distal end 74 of nozzle 68 is closed, but has a small jet opening 75 extending through one side thereof and joining opening 70. Jet opening 75 is angled slightly back towards base 65 to allow correct direction of spray when installed. A ring gasket 76 is inserted into groove 73 to seal nozzle 68 into opening 67, preventing leakage. Securing means for adjustably securing nozzle 68 into base 65 is, in this embodiment, a screw 77 passing through the side of base 65, and, when tightened, pushes against nozzle 68 holding it securely in place. Nozzle assembly 22 also includes attachment means for attaching base 65 to the underside of seat 15. In this embodiment, a pair of screw holes 78 extend through base 65 parallel to opening 67. Screws 79 are inserted through screw holes 78 and into seat 15. Those skilled in the art will understand that various forms of adhesive may also be used. FIG. 5 shows nozzle assembly 22 attached to seat 15 with seat 15 lowered into operating position. A spray 81 can be seen exiting jet opening 75, and extending upward through the center of seat 15.

Flexible tube 27 is coupled to nozzle assembly 22 by inserting second end 29 of flexible tube 27 through inlet 69 of base 65. An expander plug 80 is inserted into second end 29 of flexible tube 27 preventing its removal and securely anchoring it in base 65. First end 28 of flexible tube 27 is coupled to flow release valve 25 by sliding a nut 82 over first end 28. An expander plug 83 expands first end 28, preventing its removal from nut 82. A joint 84, generally cylindrical with threads at both ends, is screwed into nut 82. The opposite end of joint 84 is screwed into threaded outlet 57, coupling tube 27 to flow release valve 25.

A second embodiment, generally designated 85, of the present invention is illustrated in FIGS. 6 and 7. Adaptor 23, identical to that in first embodiment 20, is used. In this embodiment, however, flow regulator valve 24 and flow release valve 25 are separate. Flow regulator valve 24 is coupled to adaptor 23, but first end 28 of flexible tube 27 is coupled directly to flow regulator valve 24, not flow release valve 25. In this embodiment a flow release valve 87 is part of a nozzle assembly 88. Nozzle assembly 88 is substantially similar to nozzle assemble 22, having a base 89 with an axial opening 90 into which a nozzle 92, identical to nozzle 68 of first embodiment 20, is inserted. An inlet 93 joins opening 90 and extends perpendicularly through one side of base 89. Just prior to joining the lower, closed end of opening 90, the diameter of inlet 93 is reduced, forming shoulders 94. A valve opening 95 continues from opening 90, extending through the side of base 89 opposite inlet 93. A cylindrical block 97 is inserted into valve opening 95 and extends through opening 90 into inlet 93. A first gasket 98 encircles block 97 inside inlet 93. Water pressure pressing against block 97 forces it and gasket 98 to seal against shoulder 94 preventing water from passing into opening 90. A second gasket 100 encircles block 97 inside valve opening 95 preventing water exiting through valve opening 95. An extension rod 102 is attached to the end of block 97 extending from valve opening 95, and as shown in FIG. 6, extends past the edge of seat 15 when installed. A button 103 is attached to extension rod 102 for ease in pushing rod 102 towards nozzle assembly 88. When rod 102 is moved towards nozzle assembly 88, block 97 slides further into inlet 93 moving gasket 98 away from shoulder 94. This allows water to enter opening 90 and exit through nozzle 92. A rod support 104 slidably holds rod 102 to seat 15. Rod support 104 is a cylinder 105 through which rod 102 passes, which is attached, in this embodiment, to seat 15 by a screw 107 extending through cylinder 105 and into seat 15. Those skilled in the art will understand an adhesive may be used. Nozzle assembly 88 is attached to seat 15 the same way as nozzle assembly 22 of first embodiment 20.

Figure 10:
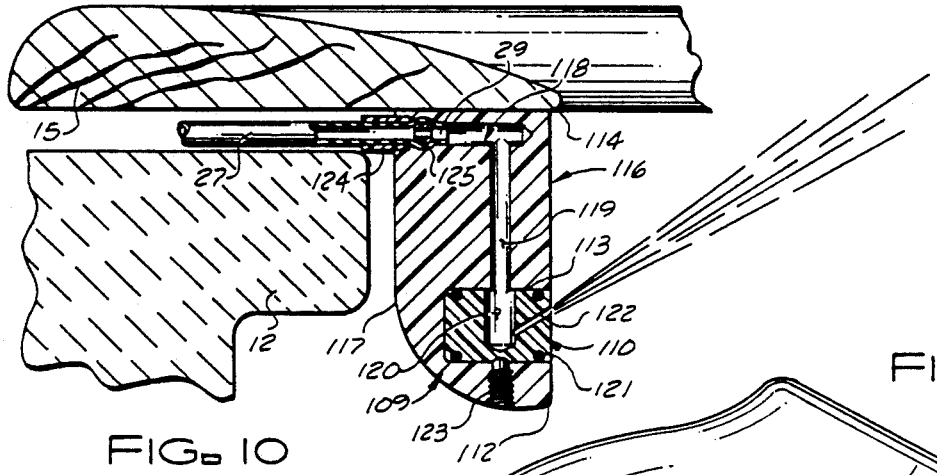
FIG. 10 is a sectional side view of the modified nozzle assembly shown in FIGS. 8 and 9 attached to a toilet in operating position.

Turning now to FIG. 8, an alternate embodiment of nozzle assembly 22 is illustrated. In this embodiment, everything is identical to first embodiment 20 except nozzle assembly 22. Here an alternate nozzle assembly, generally designated, 108 is attached to the underside of seat 15. Nozzle assembly 108 has a base 109 into which a nozzle 110 is inserted. Base 109 is contoured to fit flush against the bottom of seat 15 and gradually sloping to a curved point 112. At this lowest curved point 112 a nozzle opening 113 is formed. As illustrated by FIGS. 8 and 9 the form of base 109 allows for easy cleaning due to its curved structures. Turning now to FIG. 10, it can be seen that base 109 has a planar surface 114, which fits flush against seat 15, a front face 116, also planar, forms a 90° angle with planar surface 114. Side 117 opposite front face 116 is curved. Nozzle opening 113 is formed in base 109 extending into front face 116 at its furthest point 112 from planar surface 114. An inlet 118 extends into base 109 parallel to planar surface 114 from side 117. A water passage 119 is formed parallel to front face 116 extending perpendicularly from inlet 118 and joining nozzle opening 113. Nozzle 110 is a cylindrical block 121 with an opening 120 extending partway there into. When nozzle 110 is inserted in nozzle opening 113 opening 120 corresponds to water passage 119. A jet outlet 122 extends from opening 120 to the surface of cylindrical block 121 which is flush with front face 116 when nozzle 110 is inserted. Nozzle 110 is held in place by a screw 123, extending through base 109 to press against block 121.

Flexible tube 27 is coupled to base 109 by inserting second end 29 through a collar 124 ten inserting an expander plug 125 to prevent second end 29 from being removed from collar 124. Second end 29 is then inserted into inlet 118 and held securely in place by collar 124 which fits tightly into inlet 118.

Figure 11:
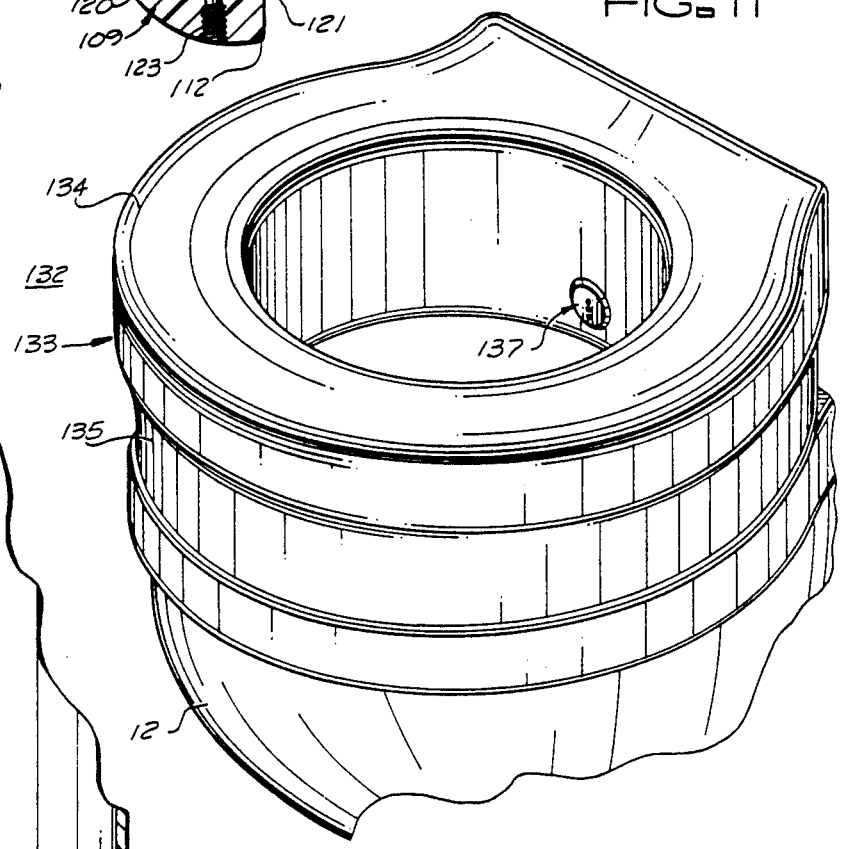
FIG. 11 is a perspective view of a further embodiment of the present invention having an alternate nozzle built into a seat extension.
Figure 12:
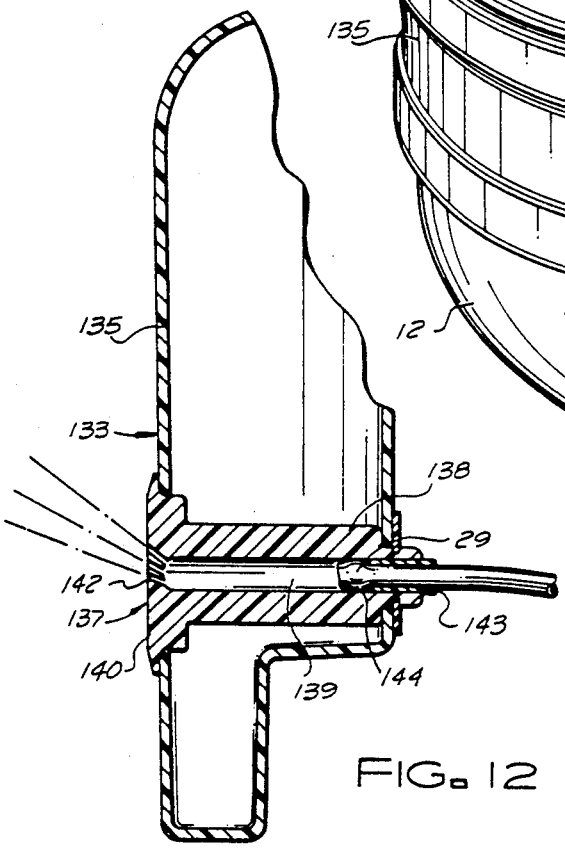
FIG. 12 is a sectional side view of the nozzle assembly of the alternate nozzle illustrated in FIG. 11.
Figure 13:
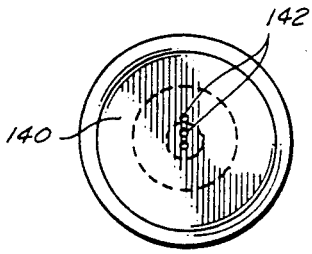
FIG. 13 is a front view of the alternate nozzle illustrated in FIGS. 11 and 12.

FIGS. 11–13 illustrate a third embodiment of the invention generally designated 130. This embodiment includes an adaptor and valves which are identical to those illustrated and described in connection with first embodiment 20. However, the nozzle assembly 132, which includes both nozzle 137 and base 133, has been specially configured to assist a person who has trouble sitting, such as an old person, by reducing the distance the person must lower himself. Specifically, base 133 is a stationary raised toilet seat which replaces the conventional hinged seat 15 of the earlier embodiments. Top surface 134 of base 133 resembles the top surface of conventional seat 15, but is supported in an elevated position by extended sidewalls 135, which sit on the upper rim of bowl 12. A nozzle 137 fits into sidewall 135 at the back.

FIG. 12 illustrates nozzle 137 which is a cylinder 138 having an opening 139 extending along an axis thereof. One end of cylinder 138 has a face plate 140 through which jet openings 142 extend, coupling with opening 139. Nozzle 137 in this embodiment has three jet openings 142 to increase the area covered by the spray of water. This increases the cleaning area of the device, but one skilled in the art will realize that one jet opening as in the preceding embodiments may be used. Second end 29 of flexible tube 27 is coupled to nozzle 137 by inserting first end 29 through a collar 143. An expander plug 144 is inserted into tube 27 to prevent its withdrawal from collar 143. Collar 143 is inserted into opening 139 opposite face plate 140.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A hygienic spray device for use on a conventional toilet having a tank, a waterline, a bowl and a seat coupled to the bowl by a hinge, said device comprising:

a) "T"-type adaptor coupling said waterline to said tank;

b) control means coupled to said adaptor for controlling the flow of water through said device;

c) a nozzle assembly attached to said seat and coupled to said control means, said nozzle assembly including i) a base member coupled to said toilet seat for movement therewith, said base member projecting generally downwardly into said bowl when said seat is in a horizontal position, said base member including a flow passage extending generally downwardly from an inlet end to an outlet end, and ii) a nozzle carried in a lower end of said base member, said nozzle defining at least one jet opening communicating with the outlet end of said flow passage and extending at an oblique angle relative to said flow passage to direct spray from said flow passage upwardly and outwardly toward a user seated on said seat; and e) a resiliently flexible tube having i) a first end coupled to said control means, and ii) a second end received in said inlet end of said flow passage in said base member.

2. A device as claimed in claim 1, further comprising attachment means for securing said base member to said seat and for preventing movement of said base member relative said seat.

3. A device as claimed in claim 2, wherein said attachment means comprises an adhesive.

4. A device as claimed in claim 2, wherein said attachment means comprises at least one screw extending through said base member into said seat.

5. A device as claimed in claim 1, wherein said base member is integral with said seat.

6. A device as claimed in claim 1, wherein said nozzle is removably carried in said base member.

7. A device as claimed in claim 1, wherein said nozzle is mounted for rotation within said base member.

8. A device as claimed in claim 1, wherein said control means comprises:

a) a flow regulator valve coupled to an outlet of said adaptor by a joint; and b) a flow release valve coupled to said flow regulator valve.

9. A device as claimed in claim 8, wherein said flow regulator valve comprises:

a) a housing defining an axial flow path; and b) a valve body extending through said housing and mounted for rotation about an axis perpendicular to said axial flow path, said valve body defining an opening;

wherein the volume of flow through said device is selectively controlled by rotating said valve body to vary the alignment of said opening in said valve body with said axial flow path.

10. A device as claimed in claim 9, wherein said flow regulator valve comprises:

a) a housing defining an axial flow path;

b) an outlet passage extending orthogonally to said axial flow path;

c) a valve seat formed in said axial flow path upstream of said outlet passage;

d) a valve body mounted for movement in said axial flow path, and normally residing against said valve seat to prevent flow through said outlet passage; and e) manually operable actuator means extending from said valve body for moving said valve body away from said valve seat to allow flow through said outlet passage.

11. A device as claimed in claim 10, wherein said flow release valve housing is unitary with said flow regulator valve housing.

12. A device as claimed in claim 10, wherein said flow release valve housing is unitary with said base member of said nozzle assembly.

13. A hygienic toilet seat assembly for use on a conventional toilet having a tank, a waterline and a bowl having an upper rim, said toilet seat including in combination:

a) a raised seat for positioning on the upper rim of said bowl in place of a conventional hinged toilet seat and configured to improve accessibility of said toilet to a handicapped user, said raised seat comprising a hollow body having i) a lower surface for placement on said upper rim, ii) an upper surface for supporting said user in a seated position, iii) a generally annular extended outer sidewall extending between said lower surface and said upper surface, said extended outer sidewall having a predetermined height considerably greater than the thickness of said conventional hinged toilet seat, iv) a generally annular extended inner sidewall having a predetermined height at least as great as the height of said outer sidewall, and v) attachment means for securing said body to said rim and preventing relative movement therebetween; and b) a spray device comprising i) adapter means coupling said water line to said tank, ii) control means coupled to said adaptor for controlling the flow of water through said device;

iii) a nozzle assembly carried in said hollow body, said nozzle assembly including:

a nozzle body having a front end extending through said extended inner sidewall and a rear end extending through said extended outer sidewall, and:

a flow passage extending in an axial direction between an inlet formed in said rear end of said nozzle body and an outlet formed in said front end of said nozzle body; and iv) a resiliently flexible tube having a first end coupled to said control means and a second end received in said inlet of said flow passage in said nozzle body.

14. A toilet seat assembly as claimed in claim 13, wherein said outlet comprises at least one jet opening extending at an oblique angle relative to said flow passage to direct spray from said flow passage upwardly and outwardly toward a user seated on said raised seat.

15. A toilet seat assembly as claimed in claim 14, comprising a plurality of said angled jet openings.

16. A device as claimed in claim 13, wherein said control means comprises:

a) a flow regulator valve threadedly coupled to an outlet of said adaptor; and b) a flow release valve coupled to said flow regulator valve.

* * * * *